US010863878B2

(12) United States Patent
Royce

(10) Patent No.: US 10,863,878 B2
(45) Date of Patent: Dec. 15, 2020

(54) SYSTEM AND METHOD FOR IMPROVED RECIRCULATING VACUUM WITH REMOVABLE NOZZLE

(71) Applicant: Luke R. Royce, Blaine, WA (US)

(72) Inventor: Luke R. Royce, Blaine, WA (US)

( * ) Notice: Subject to any disclaimer, the term of this patent is extended or adjusted under 35 U.S.C. 154(b) by 247 days.

(21) Appl. No.: 16/020,914

(22) Filed: Jun. 27, 2018

(65) Prior Publication Data

US 2018/0310787 A1 Nov. 1, 2018

Related U.S. Application Data

(63) Continuation-in-part of application No. 15/283,021, filed on Sep. 30, 2016, now abandoned.

(51) Int. Cl.

| | |
|---|---|
| ***A47L 9/08*** | (2006.01) |
| ***A47L 7/04*** | (2006.01) |
| ***A47L 5/30*** | (2006.01) |
| ***A47L 5/14*** | (2006.01) |

(52) U.S. Cl.

CPC *A47L 9/08* (2013.01); *A47L 5/14* (2013.01); *A47L 5/30* (2013.01); *A47L 7/04* (2013.01)

(58) Field of Classification Search

CPC ..... A47L 9/08; A47L 7/04; A47L 5/30; A47L 5/14

See application file for complete search history.

(56) References Cited

U.S. PATENT DOCUMENTS 3,694,848 A * 10/1972 Alcala ..... A47L 5/14 15/346
2006/0117518 A1* 6/2006 Hwang ..... A47L 9/0081 15/326

* cited by examiner

*Primary Examiner* — David Redding
(74) *Attorney, Agent, or Firm* — Christopher Mayle; Thomas E. LaGrandeur; Bold IP, PLLC

(57) ABSTRACT

The improved vacuum cleaner is a recirculating type vacuum cleaner with a suction mechanism, air retrieving passageway, and dirt collecting member, that has an detachable nozzle formed as an elongated hollow hose that is attached between the exhaust port on the surface of the vacuum body and an inlet on the vacuum head. The nozzle is adapted to push air downward onto the surface to be vacuumed to dislodge dirt and particles in the surface where the air and dirt into air retrieving opening on the vacuum head.

17 Claims, 2 Drawing Sheets

SYSTEM AND METHOD FOR IMPROVED RECIRCULATING VACUUM WITH REMOVABLE NOZZLE

CROSS REFERENCE TO RELATED APPLICATION

This application is a continuation in part of U.S. patent application Ser. No. 15/283,021 filed on Mar. 16, 2013.

FIELD OF DISCLOSURE

The field of disclosure generally relates to a vacuum cleaner and particularly to a recirculating vacuum cleaner in which the airflow of the suction mechanism is recirculated back through a nozzle attached to the vacuum's exhaust port to aid in the dislodging of particles and to increase cleaning efficiency.

BACKGROUND

A vacuum cleaner is a device that uses an air pump to create a partial vacuum to suck up dust and dirt, usually from floors, and from other surfaces such as upholstery and draperies. Either a dust bag or a cyclone for later disposal collects the dirt. Vacuum cleaners, which are used in homes as well as in industry, exist in a variety of sizes and models-small battery-powered hand-held devices, wheeled canister models for home use, domestic central vacuum cleaners, huge stationary industrial appliances that can handle several hundred liters of dust before being emptied, and self-propelled vacuum trucks for recovery of large spills or removal of contaminated soil.

Specialized shop vacuums can be used to suck up both dust and liquids. A vacuum's suction is caused by a difference in air pressure. A fan driven by an electric motor reduces the pressure inside the machine. Atmospheric pressure then pushes the air through the carpet and into the nozzle. Typically, as the debris receptacle gets close to being full, suction pressure drops off. Alternatively, if the nozzle portion attaches to a surface, the vacuum motor's RPM's (revolutions per minute) rises dramatically, pressure equalizes, and suction drops off drastically.

Ideally, a vacuum cleaner should provide a high level of suction power and ease of use and, yet would operate reliably and be manufactured at a modest expense. Thus, a need exists for a reliable improved vacuum cleaner to avoid the above-mentioned problems.

SUMMARY

Embodiments in the present description are directed are directed to an improved vacuum cleaner comprising, a body and head, an air retrieving passageway, the air retrieving passageway having a first end connected to the head and a second end connected to the body, the air retrieving passageway configured to receive air and dirt from an air retrieving opening within the head, a dirt collecting member attached within the body configured to receive air and dirt passing through the air retrieving opening, an exhaust port positioned on a surface of the body, the exhaust port configured to allow air to exit the body after passing through the air retrieving opening and the dirt collecting member, a suction mechanism; wherein the suction mechanism is attached within the body, the suction mechanism configured to suck air and dirt into the air retrieving opening and then into the dirt collecting member, and a nozzle, the nozzle located outside the body, the nozzle having a first end detachably coupled to the exhaust port, the nozzle having a second end detachably coupled to the head, the nozzle configured to push air from the exhaust port out through an air pushing opening within the head and into the air retrieving opening.

It is an object of the present description to provide a method for pushing and collecting dirt comprising, a providing a vacuum, the vacuum having a housing, the housing including a body and head; an air retrieving passageway, the air retrieving passageway having a first end connecting to the head and a second end connecting to the body, the air retrieving passageway configured to communicate with an air retrieving opening within the head, a dirt collecting member attaching within the body and receiving air and dirt passing through air retrieving opening, an exhaust port positioned on a surface of the body, the exhaust port allowing air to exit the body after passing through the air retrieving opening and the dirt collecting member; a suction mechanism, wherein the suction mechanism is attached within the body, the suction mechanism sucking air and dirt into the air retrieving opening and then into the dirt collecting member, an air retrieving passageway, the air retrieving passageway having a first end connected to the head and a second end connected to the body, the air retrieving passageway having an air retrieving opening within the head, detachably coupling a nozzle to the vacuum, the nozzle located outside the body, the nozzle having a first end detachably coupled to the exhaust port, the nozzle having a second end detachably coupled to the head, the nozzle pushing air from the exhaust port out through an air pushing opening within the head and into the air retrieving opening.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
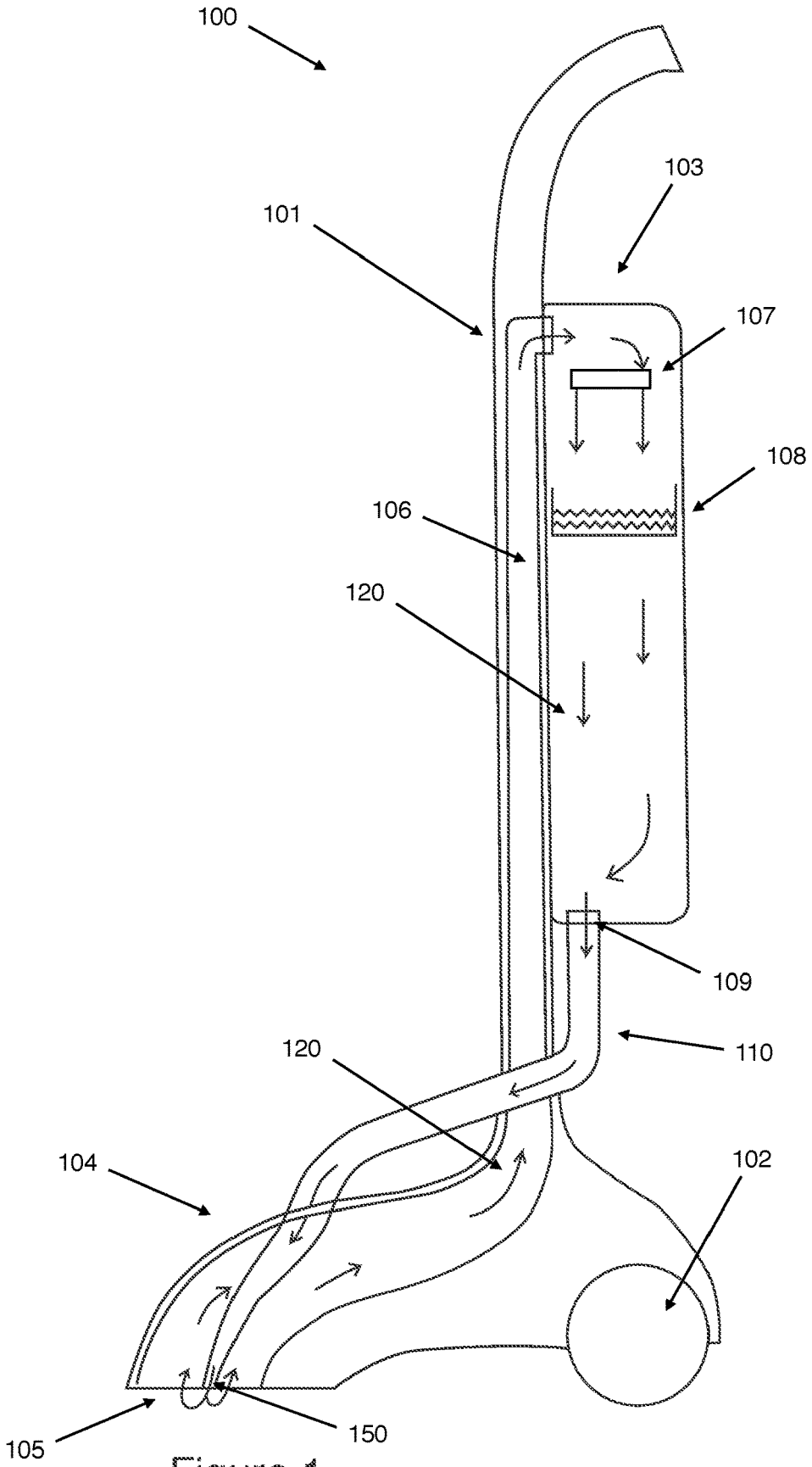
FIG. 1 illustrates a side view of the improved recirculating vacuum cleaner.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present invention recognizes the unsolved need for an improved recirculating vacuum cleaner, which infuses forced air into the surface to be cleaned or vacuumed to provide maximum suction for a particular model despite the debris receptacle nearing fullness or the suction head being attached to a surface. The vacuum cleaner's detachable nozzle is located outside of the main vacuum body thus providing greater versatility than existing systems and methods by allowing the user to use the vacuum with the nozzle or without the nozzle so the vacuum is suitable situations requiring the influx of pushed air along with suction, such as when lifting heavy objects or keeping the vacuum fixated at a certain position. The detachable nozzle outside the housing also permits the nozzle to removed and replaced more easily and efficiently if the nozzle is no longer needed for the situation or the nozzle needs to be replaced after prolonged use or from being damaged during operation.

Vacuum cleaner 100, as depicted in FIG. 1, may include, in one or more embodiments, two main components, a vacuum body such as vacuum body 103 and a vacuum head such as vacuum head 104. Vacuum cleaner 100 may include handle such as handle 101 connecting vacuum body 103 and vacuum head 103, for ease in carrying vacuum cleaner 100 from one place to another. The curved elongated shape of handle 101 facilitates the carrying of vacuum cleaner 100 and acts as a strong structural support for the stabilization of vacuum cleaner 100 when carried or leaned upon. Vacuum cleaner 100 may also include wheels such as wheels 102 for moving vacuum cleaner 100 along a surface to be cleaned.

An air retrieving passageway such as air retrieving passageway 106 may be positioned inside of handle 101. Air retrieving passageway 106 may be an elongated hollow hose and made from a plastic material such as a shop vac tube. Air retrieving passageway 106 may have one end that is removably attached to vacuum body 103 and another end attached to vacuum head 104 whereby an air retrieving opening such as air retrieving opening 105 on vacuum head 104 is adapted so air such as air 120 and dirt or other particles may flow from air retrieving opening 105 and into air retrieving passageway 106 then into vacuum body 103. Vacuum cleaner 100 depicted in the FIGS. 1 and 2 is an upright vacuum however this is non limiting and in one or more embodiments the vacuum cleaner may be a canister, stick, handheld, robotic vacuum.

Vacuum Cleaner 100 may have a suction mechanism such as suction mechanism 107 attached within housing of vacuum body 103 in operational connection with air retrieving opening 105 and air retrieving passageway 106. Suction mechanism 107 is adapted to suck air 120 and dirt into air retrieving opening 105, then through air retrieving passageway 106, and then into a dirt collecting member. Suction mechanism 107 may include a motor that drives a fan to create a vacuum or a negative pressure in the chamber. As air naturally flows from areas with higher pressure to areas with lower pressure the negative pressure allows the fan to suck air and dirt into vacuum body 103. While the negative pressure is created, the fan also expels air 120 from behind the fan, creating back-pressure that pushes air 120 and dirt downward through vacuum body 103.

Dirt collecting member may be attached within the vacuum body configured to receive air and dirt passing through air retrieving opening that is pushed down by the backpressure of suction mechanism and downwards gravity. Dirt collecting may take the form of a filter such as filter 108 is accommodated in vacuum body 103 which is in communication with air retrieving opening 105 and air retrieving passageway 106 to receive dirt and other particles that have been sucked up by the vacuum.

Vacuum body 103 may have one or more exhaust ports such as exhaust port 109 on the surface of vacuum body 103. In some embodiments exhaust port 109 is arranged to face the outer peripheral surface of the vacuum body 103. Exhaust port 109 is adapted to allow air 120 to exit vacuum body 103 after passing through air retrieving opening 105, air retrieving passageway 106, and filter 108. Exhaust port 109 may be designed to preferably cover a large enough surface area of vacuum body 103 to allow enough pressurized air to dislodge dirt and other particles on the surface to be vacuumed or cleaned but may be of any size, shape, and number depending on the situation needed.

Vacuum cleaner 100 may have a flexible nozzle such as nozzle 110 with one end that is removably attached to exhaust port 109. Nozzle 110 may be an elongated hollow hose and made from a plastic material shop vac tube. Nozzle 110 may have an outside surface that is shaped to snap fit into a recess surrounding exhaust port 109 or built into the exhaust port 109. The end of the nozzle 110 may have a substantially circular body having a same diameter slightly less diameter or than an opening or recess on exhaust port 109 on vacuum body 103 allowing for nozzle to be centered over the opening exhaust port 109 on vacuum body 103 and thereafter engaging nozzle 110 inside of the opening on exhaust port 109. This engagement applies a radial force outward from nozzle 110 against the inside surface of the opening on the exhaust port 109 to create a substantially tight seal that prevents the exiting of air 120 from vacuum body 103. Nozzle 100 may be removed applying laterally inward pressure on nozzle 110 sufficient to deform the nozzle 110, causing the circumference of the nozzle 110 to decrease and permit the ready detachment of the nozzle 110 from the recess on exhaust port 109.

In one or more non-limiting embodiments, there may be one or more stopping members on the opening of the exhaust port to discourage inadvertent separation of nozzle 110 from exhaust port 109 unless sufficient force is applied to nozzle 110 whereby the stopping member may be deformed and nozzle 110 may pass over it. Tabs may also be spaced around the inside of recess to help nozzle 110 snap into place. In one or more non-limiting embodiments, nozzle 110 may be connected to exhaust port 109 by any number of hinges, latches, adhesive, fasteners or other welding techniques.

Figure 2A:
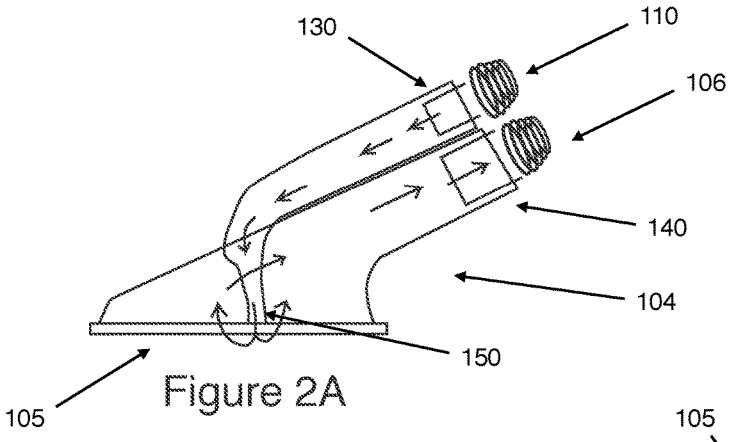
FIG. 2A illustrates a side view of the cleaning head improved recirculating vacuum cleaner.
Figure 2B:
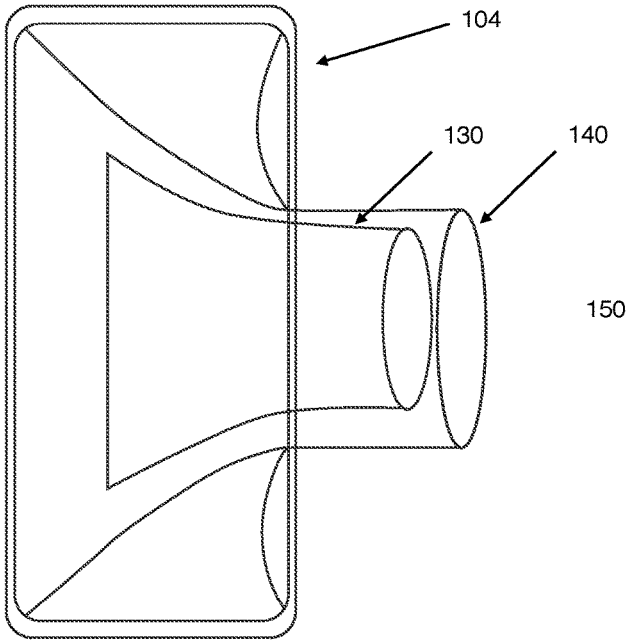
FIG. 2B illustrates a top view of the cleaning head improved recirculating vacuum cleaner.
Figure 2C:
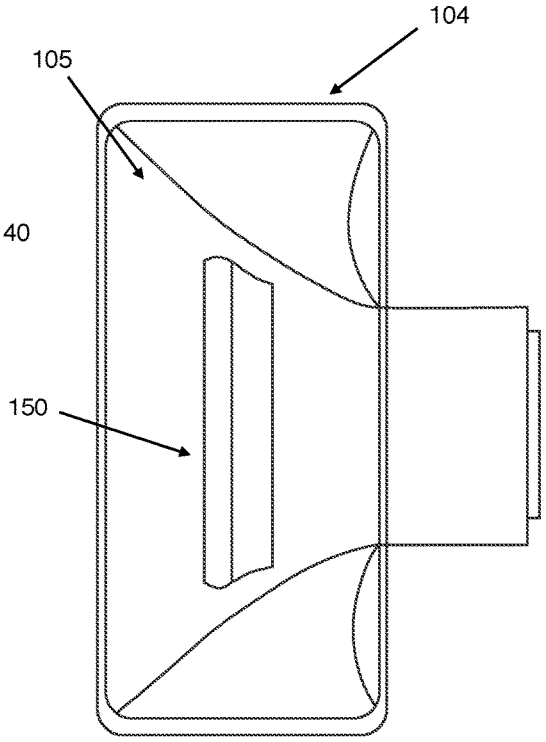
FIG. 2C illustrates a bottom view of the cleaning head improved recirculating vacuum cleaner.

Vacuum head 104 of vacuum cleaner 100 is further detailed in FIG. 2A-2C. The vacuum head may have a top surface, front surface, left surface, right surface, and a recessed bottom surface. The head may have inlet such as inlet 130 for receiving the second end of nozzle 110 whereby nozzle 110 is detachably connected to inlet 130 in a similar fashion to exhaust port 109. Inlet 130 is designed to receive air 120 pushed from nozzle 110 that is created from the back pressure of the fan in suction mechanism 107 and to move air 120 outward through an air pushing opening such as air pushing opening 150. Air 120 is then sent out of the air pushing opening 150 downward onto the surface to be cleaned or vacuumed. Air retrieving opening 105 and air pushing opening 150 terminate into elongated openings with air pushing opening 150 in the center of Air retrieving opening 105. In some embodiments the openings parallel with one another within the recess. Air 120 pushed through the air pushing opening 150 whereby air 120 dislodges dirt or other particles lodged in the surface. Air 120 then travels back into the air retrieving opening 105 where air 120 and dirt then may travel through air retrieving passageway 106, suction mechanism 107, and filter 108, restarting the cycle of air 120 once again.

Vacuum cleaner 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., or arrangements such as, for example, including more or less components, customized parts, different color combinations, parts may be sold separately.

In further one or more non-limiting embodiments vacuum head 104, nozzle 110, and air retrieving passageway 106, may be a separate entity that may be connected or retrofitted to any number of vacuum bodies and other components.

The above-described Figures illustrate the architecture, functionality, and operation of possible implementations of the invention described in the present description according to various embodiments. The detailed description of the illustrative embodiments above is described in sufficient detail to enable those skilled in the art to practice the invention. To avoid unnecessary detail, the description may have omitted certain information known to those skilled in the art.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention.

What is claimed is:

1. An improved vacuum cleaner comprising:

a body and head;

an air retrieving passageway, the air retrieving passageway having a first end connected to the head and a second end connected to the body, the air retrieving passageway configured to receive air and dirt from an air retrieving opening within the head;

a dirt collecting member attached within the body;

an exhaust port positioned on a surface of the body, the exhaust port configured to allow air to exit the body after passing through the air retrieving opening and the dirt collecting member;

a suction mechanism; wherein the suction mechanism is attached within the body, the suction mechanism configured to suck air and dirt into the air retrieving opening and then into the dirt collecting member, the suction mechanism including a motor to drive a fan to create a negative pressure wherein when the negative pressure is created, the fan expels air from behind the fan, creating back-pressure that pushes air and dirt downward through the body, the dirt collecting member configured to receive air and dirt passing through the air retrieving opening that is pushed down by the back-pressure of the suction mechanism and downwards gravity; and a nozzle; the nozzle located outside the body, the nozzle having a first end detachably coupled to the exhaust port, the nozzle having a second end detachably coupled to the head, the nozzle configured to push air from the exhaust port out through an air pushing opening within the head and into the air retrieving opening.

2. The improved vacuum cleaner of claim 1, wherein the vacuum cleaner is an upright vacuum cleaner.

3. The improved vacuum cleaner of claim 1, the exhaust port positioned on the bottom surface of the body, wherein the air and the dirt enter into the dirt collecting member nearer to a top surface of the body than the bottom surface of the body.

4. The improved vacuum cleaner of claim 3, wherein the air pushing opening and the air retrieving opening are parallel to one another with the air pushing opening positioned in the center of the air retrieving opening.

5. The improved vacuum cleaner of claim 1, the head further comprising an inlet for receiving the nozzle, the inlet configured to receive air pushed from the nozzle, and an outlet portion terminating in an elongated rectangular opening, the outlet configured to send air onto a surface to be vacuumed and into the air retrieving opening.

6. The improved vacuum cleaner of claim 1, the head having a recessed bottom surface, the air retrieving opening and air pushing opening located within the recess.

7. The improved vacuum cleaner of claim 1, the air passageway positioned within a handle, the handle connected to the body and the head, the handle extending above the body.

8. A method for pushing and collecting dirt comprising:

a providing a vacuum, the vacuum having a housing, the housing including a body and head; an air retrieving passageway, the air retrieving passageway having a first end connecting to the head and a second end connecting to the body, the air retrieving passageway configured to communicate with an air retrieving opening within the head, a dirt collecting member attaching within the body; an exhaust port positioned on a surface of the body, the exhaust port allowing air to exit the body after passing through the air retrieving opening and the dirt collecting member; a suction mechanism, wherein the suction mechanism is attached within the body, the suction mechanism sucking air and dirt into the air retrieving opening and then into the dirt collecting member, the suction mechanism including a motor to drive a fan to create a negative pressure wherein when the negative pressure is created, the fan expels air from behind the fan, creating back-pressure that pushes air and dirt downward through the body, the dirt collecting member receiving air and dirt passing through the air retrieving opening that is pushed down by the backpressure of suction mechanism and downwards gravity;

and detachably coupling a nozzle to the vacuum, the nozzle located outside the body, the nozzle having a first end detachably coupled to the exhaust port, the nozzle having a second end detachably coupled to the head, the nozzle pushing air from the exhaust port out through an air pushing opening within the head and into the air retrieving opening.

9. The method of claim 8, further comprising providing a handle.

10. The method of claim 8, wherein the dirt collecting member is positioned within the housing between the suction mechanism and the exhaust port.

11. The method of claim 8, wherein the nozzle is formed as an elongated hollow hose.

12. The method of claim 8, wherein the air pushing opening and the air retrieving openings take the form of elongated openings.

13. The method of claim 12, wherein the air pushing opening and the air retrieving opening are parallel to one another with the air pushing opening positioned in the center of the air retrieving opening.

14. The method of claim 8, the head further comprising an inlet for receiving the nozzle, the inlet configured to receive air pushed from the nozzle, and an outlet portion terminating in a elongated rectangular opening, the outlet sending air onto a surface to be vacuumed and into the air retrieving opening.

15. The method of claim 8, the head having a recessed bottom surface, the air retrieving opening and air pushing opening located within the recess.

16. The method of 10, the air passageway positioned within a handle, the handle connecting to the body and the head, the handle extending above the body.

17. An improved upright vacuum cleaner comprising:

an air retrieving passageway, the air retrieving passageway an elongated tube;

a nozzle, the nozzle an elongated tube;

a vacuum head, the vacuum head having an inlet for receiving the nozzle and the air retrieving passageway; and the air retrieving passageway having a first end detachably coupled to an air retrieving opening in the vacuum head; the air retrieving passageway having a second end configured to connect to a vacuum body; the nozzle having a first end detachably coupled to an air pushing opening in the vacuum head, the nozzle having a second end configured to connect to an exhaust port of the vacuum body, the exhaust port configured for pressurized air to be pushed from the exhaust port through the nozzle to the vacuum head to dislodge particles on a surface.

* * * * *